US005579808A

United States Patent [19]

Mikol et al.

[11] Patent Number: 5,579,808

[45] Date of Patent: Dec. 3, 1996

[54] PERMANENT CORE PLUMBING PRODUCT

[75] Inventors: Erwin F. Mikol, Westlake; Andrew G. Pawlyszyn, North Royalton, both of Ohio

[73] Assignee: Moen Incorporated, North Olmsted, Ohio

[21] Appl. No.: 427,140

[22] Filed: Apr. 24, 1995

Related U.S. Application Data

[63] Continuation-in-part of Ser. No. 225,633, Apr. 11, 1994, abandoned.

[51] Int. Cl.[6] ..... E03C 1/04

[52] U.S. Cl. ..... 137/801; 4/678; 137/375

[58] Field of Search ..... 4/678; 137/375, 137/801

[56] References Cited

U.S. PATENT DOCUMENTS

| | | | |
|---|---|---|---|
| 1,890,357 | 12/1932 | Barber | 137/375 |
| 1,981,825 | 11/1934 | Miller | 137/375 |
| 2,367,809 | 1/1945 | Stein et al. | 137/801 |
| 2,752,129 | 6/1956 | Modine | 138/157 X |
| 3,511,283 | 5/1970 | Iannone | 138/143 |
| 3,568,723 | 3/1971 | Sowards | 138/143 |
| 3,590,876 | 7/1971 | Young | 137/801 |
| 4,513,769 | 4/1985 | Purcell | 137/801 X |
| 4,884,596 | 12/1989 | Byers et al. | 137/801 |
| 5,297,587 | 3/1994 | Johnson | 137/143 |

*Primary Examiner*—Gerald A. Michalsky

*Attorney, Agent, or Firm*—Dorn, McEachran, Jambor & Keating

[57] ABSTRACT

A plumbing part is made from a permanent core and a body cast around the core. The core is formed of a material which meets the retirements as to the permitted leachability of lead and/or other undesirable materials from the core into water flowing through it. The core material has a melting point preferably at least 200° F. above that of the cast body. The core also has a coefficient of expansion which is equal to or less than that of the material fuming the cast body.

2 Claims, 1 Drawing Sheet

18
32
34
36
42
44
20
10
12
22
28
30
26

18
20
40
42
34
36
38
32
14
12
16
24
26
22
28

PERMANENT CORE PLUMBING PRODUCT

This is a continuation-in-part of application Ser. No. 08/225,633 filed on Apr. 11, 1994, now abandoned.

THE FIELD OF THE INVENTION

Leaded brass has been used in the manufacture of water flow fixtures such as shower heads, faucets, tubspouts and the like since such devices first came into modern use. The Environmental Protection Agency (EPA) has issued regulations which limit the maximum quantity of lead that is permitted to be leached into the water from such plumbing fixtures during an overnight dwell or extensive period of non-use. Most faucets presently in use will meet the maximum leachable lead limits established by the EPA prior to 1993. However, the EPA is now reducing the maximum permissible limits, and it is widely anticipated that by the end of 1994 many faucet products currently in production will not meet the revised limits. Consequently, most of the manufacturers of water flow devices such as faucets are expending substantial effort in the redesign of their products or their manufacturing processes to meet the anticipated EPA guidelines for leachable lead.

The EPA has delegated to the National Sanitation Foundation responsibility to develop the protocol which will determine the quantity of lead leaching into the potable water supply by regulated devices such as faucets. It is anticipated that the protocol will evaluate the lead leached into the water supply during the first 19 days after installation, and that on average, faucets will be required to contribute less than 11 micrograms of lead per liter of water to the water sampled after filling and testing according to the precisely defined procedure. This procedure is defined in a document known as the NSF-61 standard.

The present invention uses a permanent core to form an essentially lead leach-free waterway inside of a brass plumbing part. There is a significant reduction or elimination of lead or undesirable materials which may leach into the potable water passing through the part and manufacturing efficiencies are obtained by the elimination of the conventional sand core. Moreover, the cast body of the product does not have many of the problems associated with cast brass parts such as metal porosity and the expense of removing sand cores, particularly if the casting is large and the sand must be removed through small openings. In addition, the need to dispose of contaminated core sand is eliminated.

SUMMARY OF THE INVENTION

The present invention relates to a plumbing part which has a permanent core and relates to a process for manufacturing a plumbing part in which the core remains a permanent part after casting.

A primary purpose of the invention is to provide a plumbing product, and a method of manufacturing such product, which eliminates or significantly reduces the potential of leaching lead or other undesirable materials into the water passing through the plumbing product.

Another purpose of the invention is to provide a plumbing product in which the core about which the exterior body of the part is cast remains as a permanent part of the product.

Another purpose is a process of manufacturing a plumbing product out of a cast material which eliminates metal porosity in the cast material, conventionally caused by core sand binder burnoff.

Another purpose is to provide a plumbing product which eliminates the defects caused by sand inclusions.

Another purpose of the invention is to provide a plumbing product which eliminates the need for a sand core on the interior of the product, thus eliminating sand core contamination, disposal problems, and related costs.

Another purpose is to provide a plumbing product which has a cast body, a permanent interior core which is formed of a material which will not leach lead, has a melting point substantially above that of the cast body material, and has a coefficient of expansion less than that of the cast body material.

Another purpose is to provide a plumbing product which has thinner cast walls than in prior products of a similar type.

Another purpose is to provide a plumbing product in which the core about which the exterior body of the part is cast remains as a permanent part of the product and which core will comply with the National Sanitation Foundation requirements for leachable lead.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figures 1, 2:
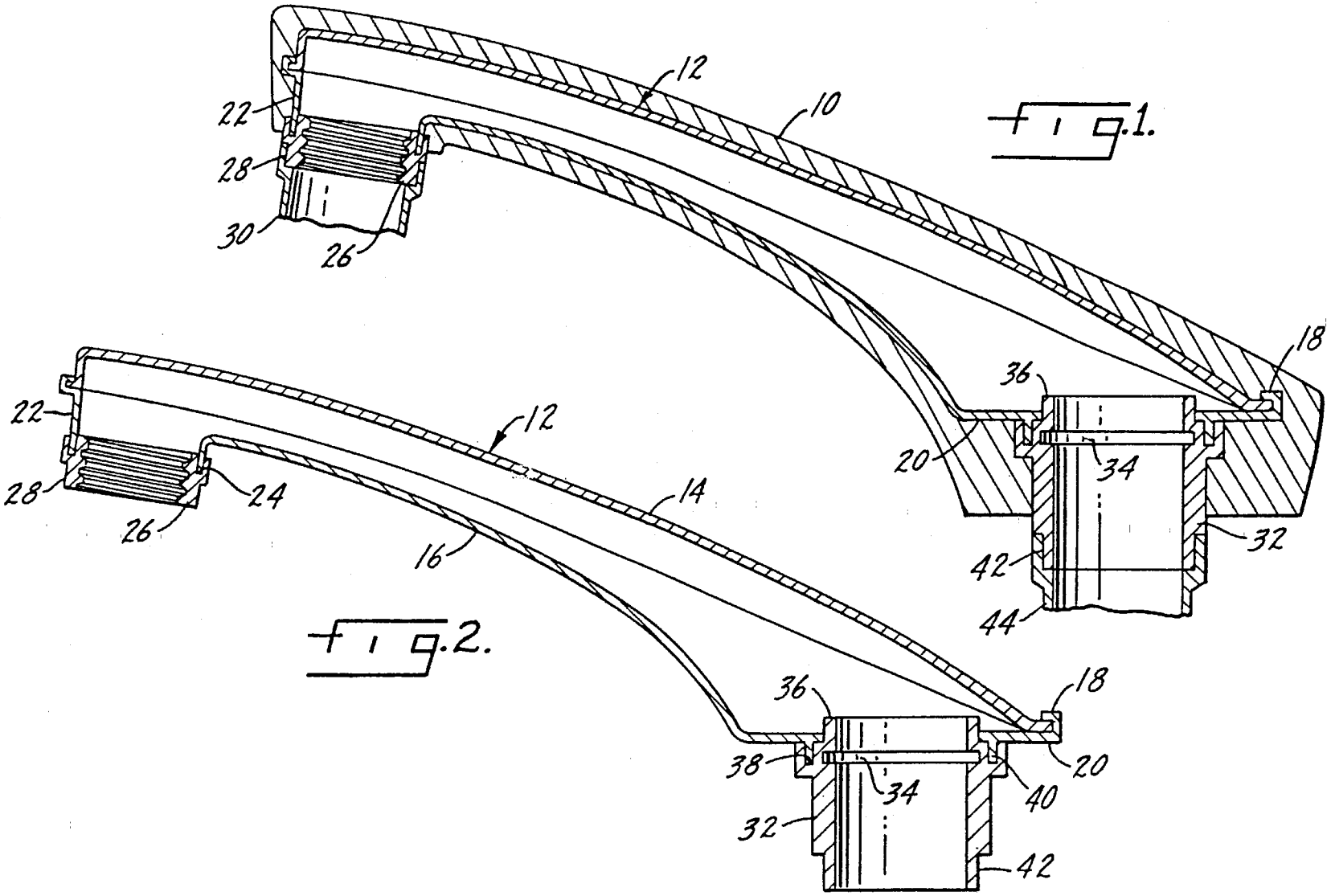
FIG. 1 is an axial section through the spout of the present invention.
FIG. 2 is an axial section of the core of the spout of FIG. 1.

With the substantial increase in concern in the United States over the leaching of lead from plumbing fixtures such as spouts and faucet housings into the potable water supply, a great many governmental bodies have passed new standards as to the amount of lead and other undesirable materials which are permitted to be leached into the water from these products. There is a very substantial effort on the part of the manufacturers of plumbing products to utilize material for waterways which eliminate the potential for the leaching of lead and other undesirable materials or at least reduce the amount that can be leached into the water to a level beneath that mandated by government controls. The present invention is specifically directed to this concern, and also to a method of manufacturing a plumbing product which reduces manufacturing costs and provides a product of significant higher quality. The invention will be described in connection with a faucet spout, although obviously the concepts disclosed are equally applicable to other plumbing products such as shower heads and faucet housings and valve bodies.

It is anticipated that the National Sanitation Foundation and its NSF-61 protocol will limit the quantity of lead which can be leached into the potable water supply over an eleven-day period to 11 mcg. The permanent core plumbing product of the present invention will satisfy such requirement.

Traditionally, in the manufacture of faucet spouts there is a sand mold which defines the rough exterior of the spout body and there is an interior or core of sand which defines the waterway. Brass is the most utilized material for the manufacture of faucet spouts. There are a number of problems associated with the use of sand cores in the manufacture of faucet spout bodies. First and foremost is the fact that if the openings in the spout are small it is difficult to remove the core sand, particularly if the casting is large. There are defects such as porosity in the metal caused by core sand binder burnoff. There may be sand inclusions in the finished product. The present invention utilizes a permanent core which remains a part of the plumbing product or spout. The core is formed of a material which will not leach lead or other undesirable materials into the potable water flowing through it. The invention will be described as using sheet metal as the core material, but other materials such as ceramics may also be useful.

As shown in the drawings, the spout will consist of a body 10 and a core 12. The body 10 will be cast brass as is conventional and will be cast to the shape generally shown. The core 12 in the preferred embodiment is formed of #304 stainless steel which has been determined to have essentially zero leaching of lead or other undesirable materials into the water passing through it. The melting point of the core material is critical, as cast brass will be poured around it. Thus, the melting point should be at least 200° F. above the melting point of the material for the cast body. Similarly, the coefficient of expansion of the core must be equal to or less than that of the casting.

The core 12 is indicated in the preferred embodiment to be formed of stainless steel and includes a formed upper stamping 14 and a formed lower stamping 16. These two elements may be formed by any conventional metal stamping process. The upper stamping or upper waterway 14 will have a peripheral outwardly extending flange 18 which will vary in size as it extends about the waterway. The lower waterway 16 has an outwardly extending flange 20, which in the assembled configuration shown in the drawings, will be attached to flange 18 by welding, crimping or folding to thus join the upper and lower waterways into a single unitary core. These two elements, the upper and lower waterway parts, will be sealingly joined at the described flanges so that there is no potential for the cast material, for example brass in the preferred form, to seep into the interior of the waterway where it could be in contact with the water.

Adjacent the discharge end of the spout core formed by the upper and lower waterways, there is a circular downwardly extending annulus 22 which extends into an annular opening 24 in a stainless steel spout discharge fitting 26. It is difficult in the manufacture of faucet spouts to machine the discharge area after the product is cast. Accordingly, the fitting 26 will be threaded on its internal diameter, for mounting a conventional aerator, prior to locating the fitting 26 in its attached position to the lower waterway.

Attached to the fitting 26 and positioned in an exterior recess 28 thereon is a transition connection 30 which is the connection to a support tree when a spout is cast. Normally, there will be at least two spouts cast in any sand mold and connection 30 provides the transition to the tree interconnecting all of the pieces to be cast. The transition connection 30 will be removed by simply sliding it off of the fitting 26 once the casting process is complete.

At the inlet end of the spout there is also a stainless steel fitting indicated at 32. The fitting 32 has a groove 34 for a sealing O-ring and has an inwardly directed annulus 36 which extends into the waterway of the core. There is an annular groove 38 which receives a circular flange 40 on the lower waterway 16 with the flange and groove providing the means for mounting the fitting 32 at the inlet end of the spout core.

The fitting 32 also has an annular exterior recess 42 which accommodates the transition connection 44 as described in connection with the discharge end of the spout.

In the manufacture of the disclosed spout, the stainless steel stampings for the upper and lower waterways will be first joined together as shown. The inlet and outlet fittings will be attached to the lower waterway after they have been suitably machined. The transition connections 30 and 44 will be connected to the fittings and as indicated above, conventionally there will be at least two spouts cast simultaneously in a single mold. The core with its attached fittings will be placed in a sand mold with the space around the core being filled with cast brass to form the body of the spout. Once the casting process is complete and the material has cooled, the assembly will be removed from the mold, the transition connections will be removed and the exterior of the spout may then be machined, polished or the like to provide the finish and shape for a completed product. The core remains within the spout and forms the waterway for the spout.

The invention eliminates the difficulties associated with sand cores in the pouring of cast brass spouts. The inlet and outlet connections for the spout no longer have to be machined after casting, as the machined inlet and outlet fittings are attached to the permanent core prior to the casting process. The invention eliminates the leaching of lead from the waterway into the potable water passing through the spout. The material forming the waterway is chosen for this purpose. The core remains in position and includes the fittings for the inlet and outlet connections. The invention provides a simplified, less expensive process for the manufacture of plumbing products such as spouts while also eliminating the concern fort the leaching of lead or other undesirable materials from the spout into the potable water.

Whereas the preferred form of the invention has been shown and described herein, it should be realized that there may be many modifications, substitutions and alterations thereto.

The embodiments of the invention in which an exclusive property or privilege is claimed are defined as follows:

1. A water faucet spout having a stainless steel core forming a waterway, which waterway is subject to a requirement as to the permitted leachability of lead therefrom into the water passing therethrough, said faucet spout having a cast brass body, said body being cast about said core, with the core remaining a permanent element of the faucet spout, said core being formed of a material which has a melting point at least 200° F. above the melting point of the material of the cast body and has a coefficient of expansion less than that of the cast body, said core being formed of a plurality of stainless steel parts joined together, preventing intrusion of the body material into the interior of the core, the core including inlet and outlet fittings attached thereto.

2. The faucet spout of claim 1 wherein the requirement as to the permitted leachability of lead is the NSF-61 protocol.

* * * * *